US005572958A

United States Patent [19]

Mader et al.

[11] Patent Number: 5,572,958

[45] Date of Patent: Nov. 12, 1996

[54] COOLING ARRANGEMENT FOR A LIQUID-COOLED MOTOR VEHICLE INTERNAL-COMBUSTION ENGINE

[75] Inventors: Reinhard Mader, Pfaffenhofen; Norbert Deussen, Munich, both of Germany

[73] Assignee: Bayerische Motoren Werke AG, Germany

[21] Appl. No.: 492,811

[22] Filed: Jun. 20, 1995

[30] Foreign Application Priority Data

Jun. 24, 1994 [DE] Germany ..... 44 22 272.6

[51] Int. Cl.[6] ..... F01P 7/14

[52] U.S. Cl. ..... 123/41.1

[58] Field of Search ..... 123/41.1

[56] References Cited

U.S. PATENT DOCUMENTS 4,615,316 10/1986 Yasuhara ..... 123/333
4,961,530 10/1990 Wagner ..... 236/34.5

FOREIGN PATENT DOCUMENTS

0184196B1 11/1987 European Pat. Off. .
0644320A1 6/1994 European Pat. Off. .
8702534 U 8/1988 Germany .
37 05 232A1 9/1988 Germany .
30 18 682C2 11/1988 Germany .
40 35 179A1 5/1992 Germany .
43 24 178A1 1/1995 Germany .

*Primary Examiner*—Noah P. Kamen
*Attorney, Agent, or Firm*—Evenson, McKeown, Edwards & Lenahan P.L.L.C.

[57] ABSTRACT

A cooling arrangement for a liquid-cooled internal-combustion engine of a motor vehicle has a temperature-controlled thermostatic valve, through which the coolant is completely or partially either guided through the radiator or, through a short-circuit pipe between the forward flow and return flow pipe, is guided past the radiator, with the distance covered by the motor vehicle after the vehicle start being compared with a limit distance. This limit distance is determined such that, when the limit distance is covered in the normal driving operation, the coolant temperature in the coolant circuit of the internal-combustion engine remains well under the opening temperature of the thermostatic valve which is not acted upon by current and therefore under the boiling temperature. The thermostatic valve is acted upon by current from the vehicle start as long as the distance covered after the vehicle start is shorter than the limit distance.

6 Claims, 1 Drawing Sheet

COOLING ARRANGEMENT FOR A LIQUID-COOLED MOTOR VEHICLE INTERNAL-COMBUSTION ENGINE

BACKGROUND AND SUMMARY OF THE INVENTION

The present invention relates to a cooling arrangement for a liquid-cooled internal-combustion engine of a motor vehicle. More particularly, the present invention is directed to a cooling arrangement comprising a radiator which is connected to the forward flow pipe and the return flow pipe of a coolant circuit of the internal-combustion engine and which either has its own closable feed opening or is fluidically connected with an expansion tank having a closable feed opening. A temperature-controlled thermostatic valve provides that the coolant is completely or partially either guided through the radiator or past the radiator by a short-circuit pipe between the forward flow pipe and the return forward pipe. The thermostatic valve is electrically heatable in order to limit or reduce the coolant temperature in the coolant circuit of the internal-combustion engine to a value which is lower in comparison to the unheated condition.

A cooling arrangement is described in German Patent Application P 43 24 178 which is not admitted prior art because it is not a prior publication. The temperature-controlled thermostatic valve of that arrangement controls the coolant temperature to an upper limit temperature during the warm-up operation and/or during the mixed operation without any heating of the expansion element of the thermostatic valve. A control unit releases, as a function of detected operating and/or environmental quantities of the internal-combustion engine as required, the heating of the expansion element. This shifts the method of operation of the cooling arrangement from the warm-up operation or from the mixed operation of the upper operating limit temperature to the mixed operation or cooling operation of a coolant temperature which is lower in comparison to the upper operating limit temperature. Because the expansion element of the thermostatic valve operates as a function of detected operating and/or environmental quantities of the internal-combustion engine, an electronic control unit is required in which the detected operating and/or environmental quantities of the internal-combustion engine are processed in a suitable manner and are used for controlling the heating of the expansion element.

The upper operating limit temperature is preferably identical to the operating temperature of the internal-combustion engine which is most advantageous with respect to the consumption and is slightly lower than the maximally permissible operating temperature of the internal-combustion engine. Preferably, the upper operating limit temperature will be above 100° C., particularly at approximately 105° C. The maximally permissible operating temperature is the highest possible temperature at which the internal-combustion engine can be normally operated without disturbances over an extended time period. As a result, even with failure of the electric heating of the expansion element, damage to the internal-combustion engine is prevented. The maximally permissible operating temperature is normally between 105° C. and 120° C.

If the expansion element is not heated electrically, an opening cross-section to the radiator occurs only as a function of the coolant temperature. This opening cross-section controls the coolant temperature to the defined upper operating limit temperature. For example, by the selection of a corresponding material with a temperature-dependent density and by a suitable construction, at a defined upper operating limit temperature, the opening cross-section of the radiator is still not maximal. That is, no pure radiator operation is achieved. Thus, by an additional heating of the expansion element, a further enlargement of the opening cross-section, and thus a displacement in the direction of the radiator operation, is possible.

European Patent EP 0 184 196 B1 describes a cooling arrangement which contains a bypass flow return pipe from the expansion tank provided with the feed opening, while bypassing the thermostatic valve, to the connection of the return flow pipe on the internal-combustion engine. For feeding coolant into the cooling system during the first feeding or during the refilling, the coolant is provided through the feed opening. While bypassing the thermostatic valve, the coolant is distributed by the bypass flow return pipe in the coolant circuit of the internal-combustion engine. By way of the return flow pipe, the coolant flows from the internal-combustion engine into the radiator. Because the pipe cross-sections are sized according to the operational requirements of the cooling system, the feeding operation is time-consuming. As a rule, the bypass flow return pipe has a smaller diameter than the forward flow pipe, and the return flow pipe and also the temperature-controlled thermostatic valve guide the cold coolant through the short circuit pipe and not through the radiator.

In order to ensure that no significant air will remain in the cooling system after a feeding, the internal-combustion engine will be idled for some time while the feed opening is open. In order to meet the consumption and emission requirements of the internal-combustion engine, the internal-combustion engine is run in the warm-up phase and in the partial-load operation at increased coolant temperatures to above the boiling temperature of the coolant. The opening temperature of the thermostatic valve corresponds to these coolant temperature data. If now, after the filling of the cooling system, the internal-combustion engine is operated while the cooling system is open, the temperature-controlled thermostatic valve will not respond, or only respond very little, when the boiling temperature of the coolant is reached. This occurs at ambient pressure. Thus, during the filling of the radiator during idling while the feed opening is open, a coolant temperature in the coolant circuit of the internal-combustion engine is above the boiling temperature. This is because the thermostatic valve, due to its high response temperature, guides the coolant essentially through the short-circuit pipe between the forward flow pipe and the return flow pipe and not through the radiator. While the expansion tank is open, coolant temperatures can occur in the cooling system at ambient pressure which are above the boiling temperature during the opening of the thermostatic valve. Then the hot coolant will be ejected, partially in the manner of a geyser, through the radiator forward flow pipe or the expansion tank forward flow pipe and the feed opening.

It is, therefore, an object of the present invention to ensure, that the ventilation is concluded before the boiling temperature is reached or that the thermostatic valve will open up before the boiling temperature is reached. Thus, the temperature will therefore not rise further. This occurs during the filling of the cooling system and the subsequent ventilation phase of the cooling system while the feed opening of the radiator or of the expansion tank is open.

This object has been achieved according to the present invention by comparing the distance covered by the motor vehicle after the vehicle start with a determined limit distance. Consequently, when the limit distance is covered in normal driving, the coolant temperature in the coolant circuit of the internal-combustion engine remains clearly below the opening temperature of the thermostatic valve containing no current and thus under the boiling temperature. From the vehicle start, however, the thermostatic valve will have a current assuming that the distance covered after the vehicle start is shorter than the limit distance.

During the warm-up phase of the internal-combustion engine, immediately after the filling of the radiator, the feed opening remains open for ventilating the cooling system. Because long distances are not covered during that phase, the thermostatic valve will permanently have current during the entire warm-up and ventilating operation. Due to the application of current, and therefore the electric heating of the thermostatic valve, the coolant temperature in the coolant circuit of the internal-combustion engine is limited to a value which is low in comparison to the unheated condition. Specifically, the value is below the boiling temperature of the coolant at ambient pressure. The opening of the thermostatic valve during the increasing heating of the coolant in the coolant circuit of the internal-combustion engine occurs at a temperature which is low in comparison to the boiling temperature of the coolant. As a result, the coolant, which now arrives in the radiator or in its expansion tank, because of the low temperature, is not ejected through the feed opening. Thus, a person carrying out the filling avoids being scalded.

Because the vehicle speed signal is already determined in the vehicle, the covered distance can advantageously be determined by integrating the vehicle speed signal.

According to another advantageous further embodiment of the present invention, the limit distance is determined as a function of the coolant temperature at the vehicle start. That is, the limit distance is determined to be longer when the the coolant temperature at the time of the vehicle start is lower.

BRIEF DESCRIPTION OF THE DRAWINGS

These and other objects, features and advantages of the present invention will become more readily apparent from the following detailed description thereof when taken in conjunction with the accompanying drawings wherein.

DETAILED DESCRIPTION OF THE DRAWINGS

Figure 1:
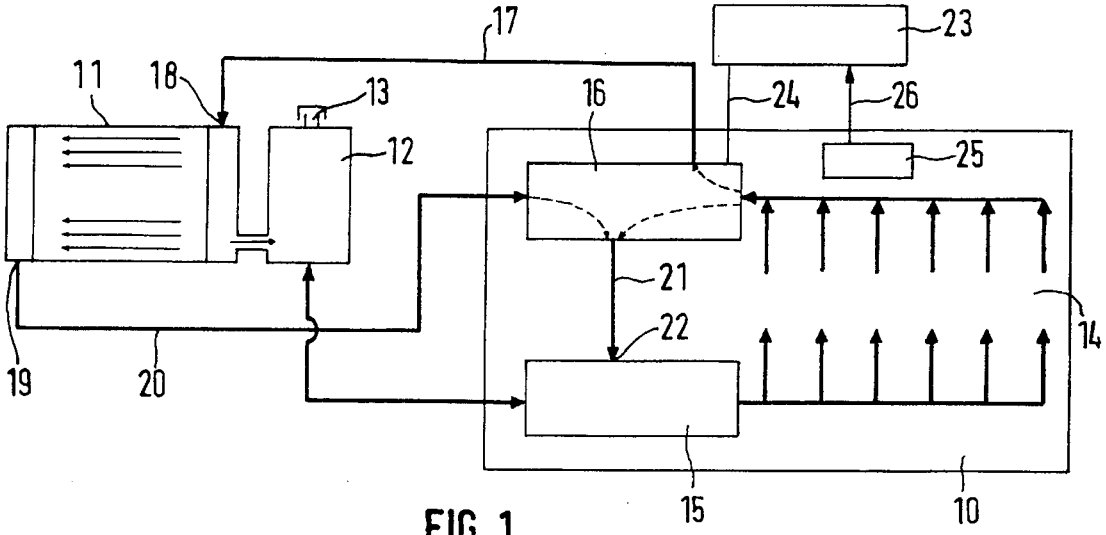
FIG. 1 is a schematic diagram of a presently preferred embodiment of the cooling arrangement according to the invention.

The cooling arrangement for an internal-combustion engine 10 illustrated in FIG. 1 comprises a radiator 11 which is fluidically connected with an expansion tank 12 having a closable feed opening 13. A coolant pump 15 is provided between the coolant circuit 14 of the internal-combustion engine 10 and the expansion tank 12. The pump 15 generates a flow of the coolant in the direction indicated by arrows. The coolant outlet of the coolant circuit 14 of the internal-combustion engine 10 is connected with a temperature-controlled thermostatic valve 16. A return flow pipe 17 leads from this thermostatic valve 16 to the inlet 18 of the radiator 11. A forward flow pipe 20 leads from the outlet 19 of the radiator 11 to the thermostatic valve 16. This thermostatic valve 16 is also connected by a short-circuit pipe 21 with an inlet 22 of the coolant pump 15. A control unit 23 is preferably integrated in an electronic engine control system.

The coolant arrangement operates essentially in three operating modes. In a first operating mode, i.e. the so-called warm-up operation, particularly after the cold start of the internal-combustion engine 10, the thermostatic valve 16, which contains, for example, a conventional expansion element (not shown) is adjusted by the control unit 23. Thus, the coolant flow coming from the coolant circuit 14 of the internal-combustion engine 10 is returned by way of the short circuit pipe 21 and the coolant pump 15 to the coolant circuit 14 of the internal-combustion engine 10. In a second operating mode, i.e. the cooling system operates in the mixed operation, the coolant coming from the coolant circuit 14 of the internal-combustion engine 10 flows partially through the radiator 11 and partially by way of the short-circuit pipe 21 back to the coolant circuit 14 of the internal-combustion engine 10. In a third operating mode, i.e. the cooling system operates in the radiator operation, the coolant coming from the coolant circuit of the internal-combustion engine 10 is returned essentially completely through the radiator 11 to the coolant circuit 14 of the internal-combustion engine 10.

The thermostatic valve 16 is, for example, heated by heating the expansion element by way of an electric line 24, when correspondingly controlled by the control unit 23. Thereby, the operating mode of the cooling arrangement can be adjusted in the direction of the radiator operation or can be changed over completely to a radiator operation.

Thus, the temperature level of the coolant, which is measured by the temperature sensor 25 and is fed to the control unit 23 by way of the line 26, is reduced in comparison to the temperature level reached in the case of an operating mode without any heating of the thermostatic valve 16. The control unit 23, which supplies the thermostatic valve 16 with electric energy by way of line 24, receives, in addition to the coolant temperature, also additional operating quantities of the internal-combustion engine 10. For example, in the collector of the air intake pipe (not shown) of the internal-combustion engine 10, another temperature sensor may be arranged in a known manner. Based upon the above description, this additional sensor can be used to sense the temperature of the intake air and transmit it to the control unit 23.

Therefore, normally, by way of the line 24, which is connected with the output of the control unit 23, the thermostatic valve 16 is electrically heated as a function of the coolant temperature and other operating quantities of the internal-combustion engine. According to the present invention, the electric heating of the thermostatic valve 16 is utilized for fast and secure filling of the entire cooling system 11. The distance covered by the motor vehicle after the vehicle start is, for this purpose, compared with a limit distance determined. That is, when the limit distance is covered in normal driving, the coolant temperature in the coolant circuit 14 of the internal-combustion engine 10 remains clearly below the boiling temperature. While the entire limit distance is covered, the thermostatic valve 16 continues to be subjected to current. As a result, the thermostatic valve 16, even at coolant temperatures clearly below the boiling temperature of the coolant, guides the coolant flow of the coolant circuit 14 of the internal-combustion engine 10 by way of the radiator 11. Thereby, the cooling liquid in the coolant circuit 14 of the internal-combustion engine 10 cannot heat up above the boiling temperature at ambient pressure. Because of the lower temperature, coolant now arriving in the radiator 11, as well as in its expansion tank 12, is not ejected through the open feed opening 13 of the expansion tank. This eliminates the danger of scalding the person carrying out the filling.

Figure 2:
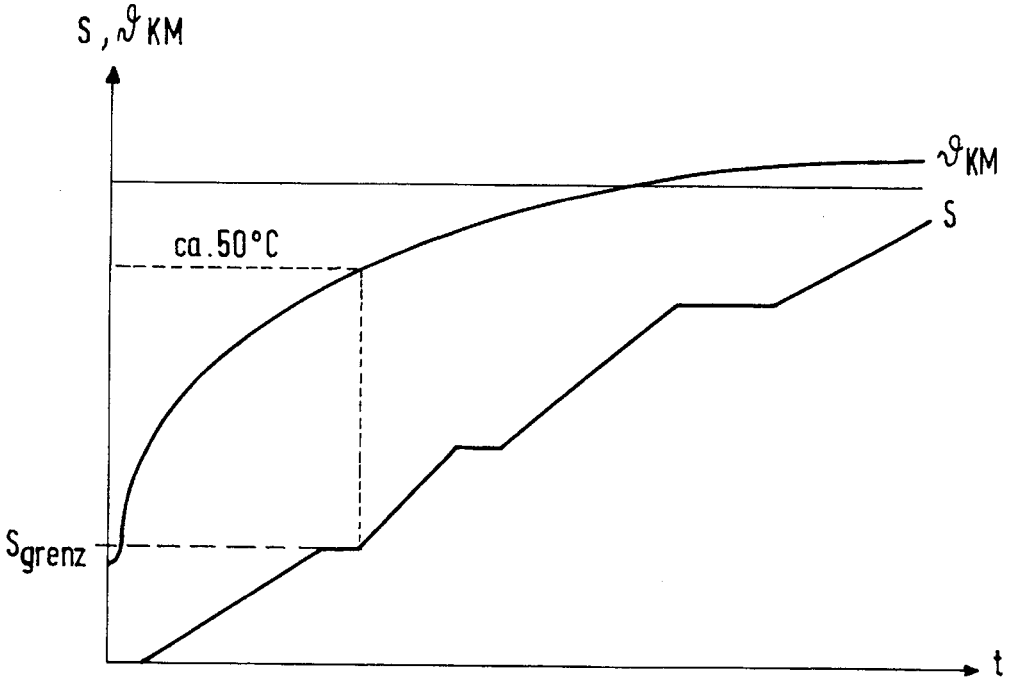
FIG. 2 is a distance-time or coolant temperature-time diagram for determining the limit distance.

In FIG. 2, the time, t, is entered on the abscissa and the distance, s, as well as the coolant temperature, $v_{KM}$, are entered on the ordinate. The curve, $v_{KM}$, shows a typical temperature course of the coolant during the normal driving operation of the motor vehicle. In this case, the curve, s, shows the covered distance as a function of the time t. If, for example, the limit distance is determined to be the value $s_{limit}$, during the normal driving operation, according to the characteristic curve, $v_{KM}$, a coolant temperature of approximately 50° C. will occur. Thus, the cooling arrangement according to the present invention assures that, on one hand, during the filling of the radiator, the coolant temperature always remains clearly below the boiling temperature and the filling can therefore take place without any danger. On the other hand, it assures that in normal driving during the warm-up phase of the internal-combustion engine 10 in the coolant circuit 14, coolant temperatures occur which are above the boiling temperature. This results in a reduction of the consumption in the warm-up phase of the internal-combustion engine.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A cooling arrangement for a liquid-cooled internal-combustion engine of a motor vehicle, comprising a coolant circuit having a forward flow pipe, a return flow pipe, a radiator operatively connected to the forward flow pipe and return flow pipe of the coolant circuit, and having one of a closable feed opening and a fluidic connection with an expansion tank with a closable feed opening, a temperature-controlled thermostatic valve configured such that coolant is one of completely and partially guided through one of the radiator and past the radiator by a short-circuit pipe between the forward flow pipe and the return forward pipe, and is electrically heatable to limit or reduce coolant temperature in the coolant circuit to a value which is lower in comparison to an unheated condition thereof, and means for heating the thermostatic valve, wherein means is provided for comparing a distance covered by the motor vehicle after the vehicle start with a limit distance determined such that, when a limit distance is covered in a predetermined normal driving operation, the coolant temperature in the coolant circuit remains clearly below the opening temperature of the thermostatic valve to which current is not then supplied, and thus remains below a boiling temperature, and current is supplied to the thermostatic valve from a vehicle start when the distance covered after the motor vehicle start is shorter than the limit distance.

2. The cooling arrangement according to claim 1, wherein the covered distance is determined by integration of a vehicle speed signal.

3. The cooling arrangement according to claim 1, wherein the limit distance is determined in dependence upon the coolant temperature at the time of the vehicle start.

4. A cooling method for a liquid cooler combustion engine of a motor vehicle in which a radiator is connected to a forward flow pipe and a return flow pipe of a coolant circuit, and which has one of a closable feed opening and a fluidic connection with an expansion tank with a closable feed opening, and a temperature-controlled thermostatic valve operatively configured so that the coolant is one of at least partially guided through the radiator and guided past the radiator by a short-circuit pipe between the forward flow pipe and the return forward pipe, and is electrically heatable to one of limit and reduce the coolant temperature in the coolant circuit of the internal-combustion engine to a value which is lower in comparison to the unheated condition, comprising the steps of comparing a distance covered by the motor vehicle after the vehicle start with a limit distance which is determined in such a manner that, when a limit distance is covered in a driving operation, the coolant temperature in the coolant circuit of the internal-combustion engine remains clearly below the opening temperature of the thermostatic valve, to which current is not supplied, and thus remains below a boiling temperature, and subjecting the thermostatic valve to current from a vehicle start when the distance covered after the motor vehicle start is shorter than the limit distance.

5. The method according to claim 4, wherein the covered distance is determined by integration of a vehicle speed signal.

6. The method according to claim 4, wherein the limit distance is determined as a function of the coolant temperature at the time of the vehicle start.

* * * * *